US007011472B2

(12) United States Patent
Martensson et al.

(10) Patent No.: US 7,011,472 B2
(45) Date of Patent: Mar. 14, 2006

(54) SEMI-SUBMERSIBLE OFFSHORE VESSEL

(75) Inventors: Nils Martensson, Vastra Frolunda (SE); Thomas Ernby, Gothenburg (SE); Yungang Liu, Gothenburg (SE)

(73) Assignee: GVA Consultants AB, Goteborg (SE)

( * ) Notice: Subject to any disclaimer, the term of this patent is extended or adjusted under 35 U.S.C. 154(b) by 165 days.

(21) Appl. No.: 10/602,832

(22) Filed: Jun. 25, 2003

(65) Prior Publication Data

US 2005/0058513 A1 Mar. 17, 2005

(30) Foreign Application Priority Data

Jun. 4, 2003 (SE) ..... 0301646

(51) Int. Cl.
*B63B 39/02* (2006.01)

(52) U.S. Cl. ..... 405/205; 114/265; 114/122

(58) Field of Classification Search ..... 405/195.1, 405/203, 205, 207; 114/121, 122, 123, 124, 114/258, 264–266
See application file for complete search history.

(56) References Cited

U.S. PATENT DOCUMENTS 3,610,193 A * 10/1971 Lacy et al. ..... 114/265
3,919,957 A * 11/1975 Ray et al. ..... 114/265
6,503,023 B1 * 1/2003 Huang et al. ..... 405/206
2001/0026733 A1 * 10/2001 Ludwigson ..... 405/224.2

* cited by examiner

*Primary Examiner*—Thomas B. Will
*Assistant Examiner*—Tara L. Mayo
(74) *Attorney, Agent, or Firm*—Birch, Stewart, Kolasch & Birch, LLP

(57) ABSTRACT

A semi-submersible offshore vessel including a rectangular ring-pontoon having a first transverse pontoon section at a first end of the vessel and a parallel second transverse pontoon section at a second end of the vessel, and two parallel pontoon sections extending between the first and the second end of the vessel. Four support columns extend upwardly from respective edge-portions of the ring-pontoon to support an upper deck structure. The first pontoon section has a vertical mean cross-section area (A) which exceeds the corresponding vertical mean cross-section area (B) of the second pontoon section, and the support columns in the second column pair each has a water-plane area (F) which exceeds the water-plane area (D) of each of the support columns in the first column pair.

18 Claims, 13 Drawing Sheets

SEMI-SUBMERSIBLE OFFSHORE VESSEL

CROSS-REFERENCES TO RELATED APPLICATIONS

This nonprovisional application claims priority under 35 U.S.C. § 119(a) on Patent Application No. 0301646-6 filed in Sweden on Jun. 4, 2003, the entirety of which is herein incorporated by reference.

BACKGROUND OF THE INVENTION

1. Field of the Invention

The present invention relates to a semi-submersible offshore vessel of a type used for deep water offshore operations such as oil and gas exploration, drilling and production. The invention introduces a novel way of minimizing motions, and primarily the vertical motions of the vessel, in order to reduce metal fatigue in—for example—riser pipe structures. The vessel exhibits a substantially rectangular ring-pontoon, at least four support columns and an upper deck structure positioned upon said support columns. The offshore vessel may for example be provided with hydrocarbon processing equipment and/or accommodation quarters.

2. Description of the Background Art

In deep water offshore operations such as oil and gas (hydrocarbon) exploration, drilling and production, a semi-submersible offshore vessel of the type described above, is connected to sub-sea wellheads and other installations via a system of several so called riser pipes. However, Applicants have determined that the background art suffers from the following disadvantages.

Drilling operations as well as seabed-to-surface transportation of hydrocarbons (referred to as "production") are effected through such riser pipes. Since these vessels often operate at considerable depths, the riser pipes of considerable length—often several thousand meters long—are used. Production riser pipes are often made of steel, so called Steel Catenary Risers (SCR), and are sensitive to metal fatigue as the pipes are subjected to forces and motions caused primarily by the wave excited vertical motions of the semi-submersible offshore vessel.

Several designs adapted to primarily minimize vertical motions of offshore vessels are previously known. These designs, however, concentrate on minimizing the vertical motion of the vessel in general, the vertical motion generally being the predominant sea-induced motion in deep sea operational areas with long wave period ranges above 10 seconds. The applicants have found that the greatest problems with riser pipe fatigue are encountered at shorter wave period ranges below 7–8 seconds.

SUMMARY OF THE INVENTION

The present invention overcomes the shortcomings associated with the background art and achieves other advantages not realized by the background art.

The above mentioned problems are solved b y concentrating the motion reducing measures to one end of the vessel hull, with the objective to locally minimize the vertical motions within the wave period range below 7–8 seconds at this end. In order to do this, both the vertical translation (heave) and the rotation (pitch or roll) multiplied with the lever arm from the center of rotation has to be minimized. The inventive approach is to:

move the center of rotation towards one end of the vessel.

balance the wave exciting forces in heave and pitch in order to obtain as much counteracting wave forces as possible.

This is achieved by rendering one end of the vessel (below referred to as the second end) rotationally "stiff" by providing the support columns in a second column pair with relatively large water-plane areas, in combination with a relatively slender conFIG.uration of a corresponding second transversal pontoon section, which results in low exciting forces in the vertical direction at the second end compared to the first end of the vessel. The first end, on the other hand, is rendered rotationally "weak" by providing the support columns in the first column pair with relatively small water-plane areas, in combination with a relatively wide conFIG.uration of the first transversal pontoon section—which results in higher exciting forces in the vertical direction at the first end.

The invention thus provides a semi-submersible offshore vessel. The vessel exhibits a first end, for example constituting the forward end of the vessel, and a second end, for example constituting the aft end of the vessel—or vice versa, said vessel comprising: a substantially rectangular ring-pontoon including a first transverse pontoon section located at the first end of the vessel; a second transverse pontoon section located at the second end of the vessel, said second transverse pontoon section being parallel to the first transverse pontoon section, the ring-pontoon further including two mutually parallel longitudinal pontoon sections extending between said first and second end of the vessel; at least four support columns extending upwardly from respective edge-portions of said ring-pontoon, said support columns being arranged in a first column pair located at the first end of the vessel and a second column pair located at the second end of the vessel; an upper deck structure positioned upon said support columns.

The invention is particularly characterized in that the first transverse pontoon section has a vertical mean cross-section area which exceeds the corresponding vertical mean cross-section area of the second transverse pontoon section, and the support columns in the second column pair each has a water-plane area which exceeds the water-plane area of each of the support columns in the first column pair.

In a suitable embodiment, the square root of the water-plane area of the support columns in the first column pair is less than the longitudinal mean width of the first transverse pontoon section.

In one embodiment of the invention, the square root of the water-plane area of the support columns in the second column pair exceeds the longitudinal mean width of the second transverse pontoon section.

In one embodiment, the second transverse pontoon section has an outer side which at least at pontoon top level is aligned with transverse outer sides of the columns in the second column pair, and an inner side which at least at pontoon top level is aligned with a transverse internal bulkhead within said columns in the second column pair.

In a versatile embodiment, the support columns in the first column pair each have a transverse outer side which at least at pontoon top level is aligned with an outer side of the first transverse pontoon section, and a transverse inner side which at least at pontoon top level is aligned with a transverse internal bulkhead within said first transverse pontoon section.

In another embodiment, the support columns in the first column pair each have a transverse outer side which at least at pontoon top level is aligned with a transverse internal bulkhead within said first transverse pontoon section, and a transverse inner side which at least at pontoon top level is aligned with an inner side of the first transverse pontoon section.

Advantageously, the first transverse pontoon section has a vertical mean cross-section area which exceeds the corresponding vertical mean cross-section area of the second transverse pontoon section by a factor of between 1.5 and 4.0, preferably between 2.0 and 3.0.

Suitably, the second transverse pontoon section has a vertical mean cross-section area which exceeds the corresponding vertical mean cross-section area of each of the two longitudinal pontoon sections.

In an advantageous embodiment, the support columns in the second column pair each has a water-plane area which exceeds the water-plane area of each of the support columns in said first column pair by a factor of between 1.3 and 2.5, preferably between 1.5 and 2.0.

In an advantageous embodiment, the support columns are inclined upwardly and substantially radially inwardly from the ring-pontoon to the upper deck structure towards a vertical centerline of the vessel. Preferably, the edge portions of the ring-pontoon each has a horizontal mean cross-section area which equals or exceeds the corresponding water-plane area of the respective support columns.

In one embodiment of the invention, the edge portions of the ring-pontoon include narrowing transition cone elements adapted to bridge differences in cross sectional areas between pontoon sections and the edge portions.

In a favorable embodiment, the second transverse pontoon section has a height which exceeds its width. Suitably, one or more steel catenary riser pipes are attached to said second pontoon section. In one embodiment, a derrick for performing offshore drilling operations may be positioned near the second end of the vessel.

Other features and advantages of the invention will be further described in the following detailed description of embodiments. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
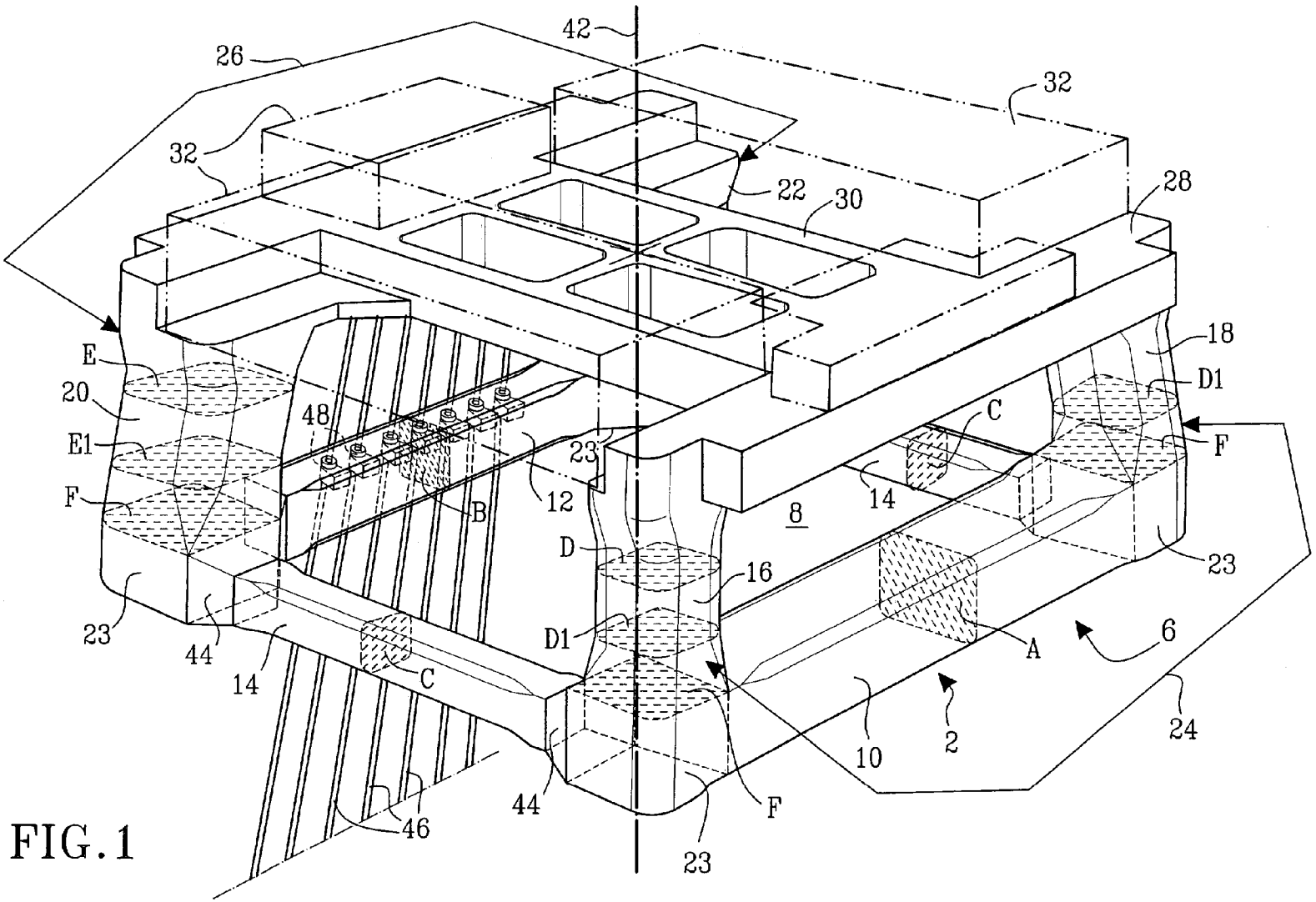
FIG. 1 shows a simplified perspective view of a semi-submersible offshore vessel according to a first exemplary embodiment of the invention.

The present invention will hereinafter be described with reference to the accompanying drawings. In FIG. 1, reference numeral 1 denotes a semi-submersible offshore vessel according to a first exemplary embodiment of the invention. The offshore vessel 1 exhibits a first end 2 or example constituting the forward end of the vessel 1, and a second end 4, for example constituting the aft end of the vessel 1—or vice versa depending on definition preferences due to some embodiments being essentially of a square configuration.

The offshore vessel 1 includes a substantially rectangular ring-pontoon 6. The term "ring-pontoon" is here defined as a closed pontoon structure, which encloses a central opening 8. The ring-pontoon 6 includes a first transverse pontoon section 10 located at the first end 2 of the vessel 1, and a second transverse pontoon section 12 located at the second end 4 of the vessel 1. The second transverse pontoon section 12 is parallel to the first transverse pontoon section 11.

Furthermore, the ring-pontoon 6 includes two mutually parallel longitudinal pontoon sections 14 extending between said first end 2 and second end 4 of the vessel 1.

Although the offshore vessel 1 essentially has the general shape of a square, when seen from above (see FIGS. 3 and 10), it still has—by traditional definition—has a forward end, an aft end, a starboard side and a port side. However, in order to avoid unnecessary limitation of the scope of the appended claims, these terms have here been defined in more general terms. Thus in as a non-limiting example, the first end 2 may correspond to the forward end and the second end 4 may correspond to the aft end of the vessel 1. The term "longitudinal" is here defined as a direction extending from said first end 2 to said second end 4 or vice versa, whilst the term "transverse" is defined as a direction perpendicular to said longitudinal direction.

In the shown example, four support columns 16, 18, 20, 22 extend upwardly from respective edge-portions 23 of said ring-pontoon 4. The support columns 16, 18, 20, 22 are arranged in a first column pair 24 located at the first end 2 of the vessel 1 and a second column pair 26 located at the second end 4 of the vessel 1. The shown support columns 16, 18, 20, 22 each has a rounded, generally rectangular cross-section shape, but it is to be understood that the support columns 16, 18, 20, 22 may alternatively have other cross sectional shapes, such as for example a generally circular or oval shape.

An upper deck structure 28 is positioned upon said support columns 16, 18, 20, 24. The upper deck structure 28 thus connects the support columns 16, 18, 20, 22 with each other in order to form a globally strong and resilient vessel design.

The upper deck structure 28 of the embodiment shown in FIG. 1 includes a system of beams 30, arranged in such a way as to allow one or more operation modules to be placed upon or adjacent to the support columns 16, 18, 20, 22 next to the beams 30. The operational modules 32 are only schematically indicated in FIG. 1. It should be noted that this is only one of many applicable configurations of the upper deck structure 28. The operation modules may for example contain hydrocarbon processing equipment or accommodation quarters (not shown).

As schematically shown in FIG. 1, a key feature of the invention is that the first transverse pontoon section 10 has a vertical mean cross-section area A which exceeds the corresponding vertical mean cross-section area B of the second transverse pontoon section 12. Another key feature is that the support columns 20, 22 in the second column pair 26 each has a water-plane area E which exceeds the water-plane area D of each of the support columns 20, 22 in the first column pair 24.

The term "mean cross-sectional area" refers to a general mean value of the cross-sectional area along the length of the respective pontoon section or support column with respect to any eventual local deviations from the normal cross-sectional shape.

Figure 2:
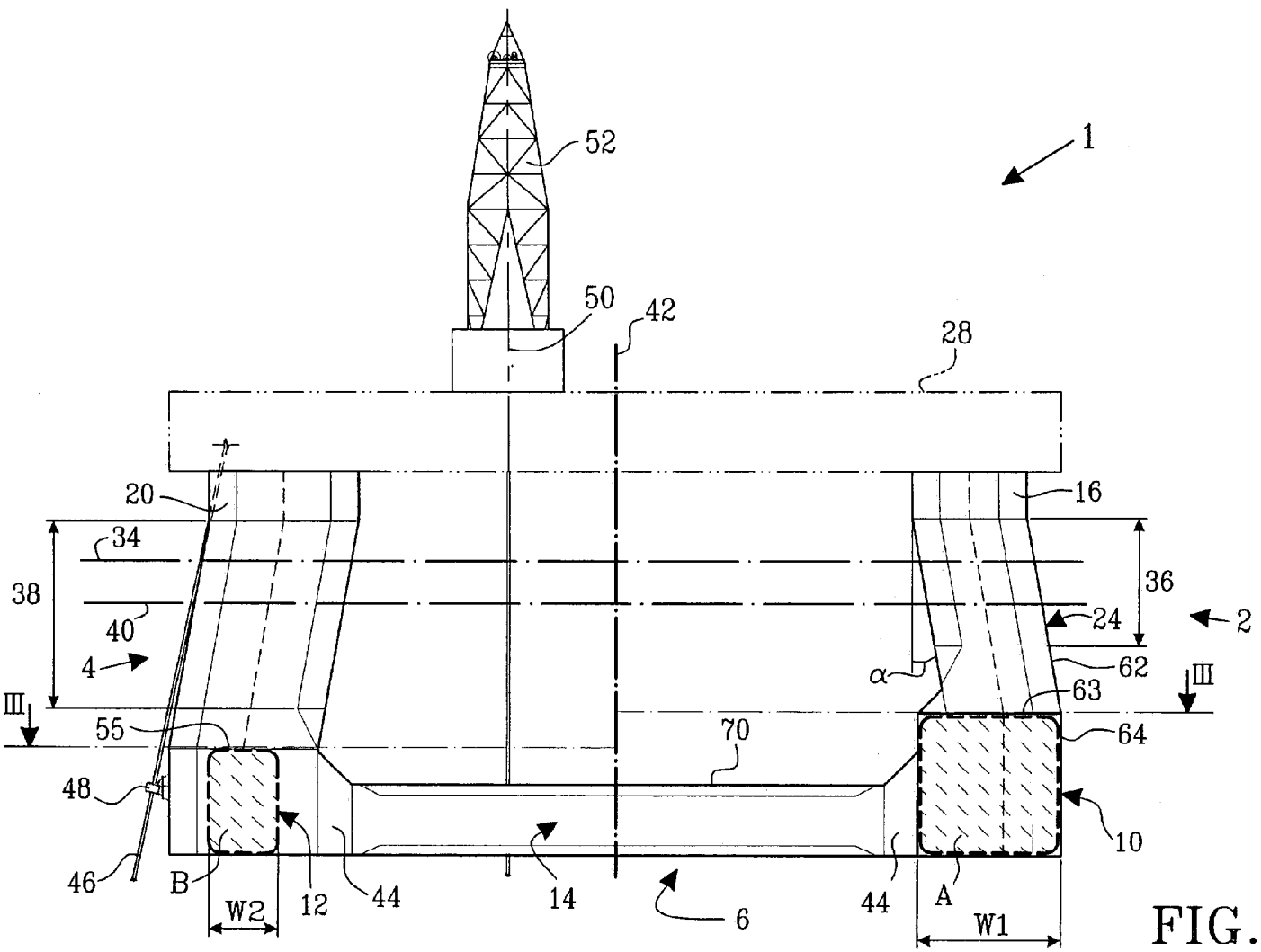
FIG. 2 shows a simplified side view of an offshore vessel in substantially in accordance with the embodiment previously shown in FIG. 1, only here the vessel is provided with a derrick for performing offshore drilling operations.

The term "water-plane area" of the support columns 16, 18, 20, 22 primarily refers to a water-plane area at or about the operational draught of the vessel 1, as illustrated by the horizontal operational draught waterline 34 in FIG. 2 and other figures. However, in the shown embodiments, the water-plane area D of each of the support columns 16, 18 in the first column pair 24 remain substantially constant along a vertical portion 36, as indicated by the double arrow to the right in FIGS. 2 and 9 respectively. Correspondingly, the water-plane area E of each of the support columns 16, 18 in the second column pair 26 remain substantially constant along a vertical portion 38, which is indicated by the double arrow to the left in FIGS. 2 and 9 respectively. Above and below the vertical portions 36 and 38, the support columns 16, 18, 20, 22 may conveniently flare out somewhat so as to conform to the edge-portions 23 of the ring-pontoon 6 and the upper deck-structure 28, respectively. This relationship is further illustrated in FIG. 1 by means of the lower water-plane areas $D_1$ and $E_1$ respectively, wherein $D_1$=D and $E_1$=E. In FIG. 2, a storm draught waterline 40 is also shown, at which the water-plane areas of the respective support columns equal the water-plane areas at said operational draught in accordance with the above description.

Figure 9:
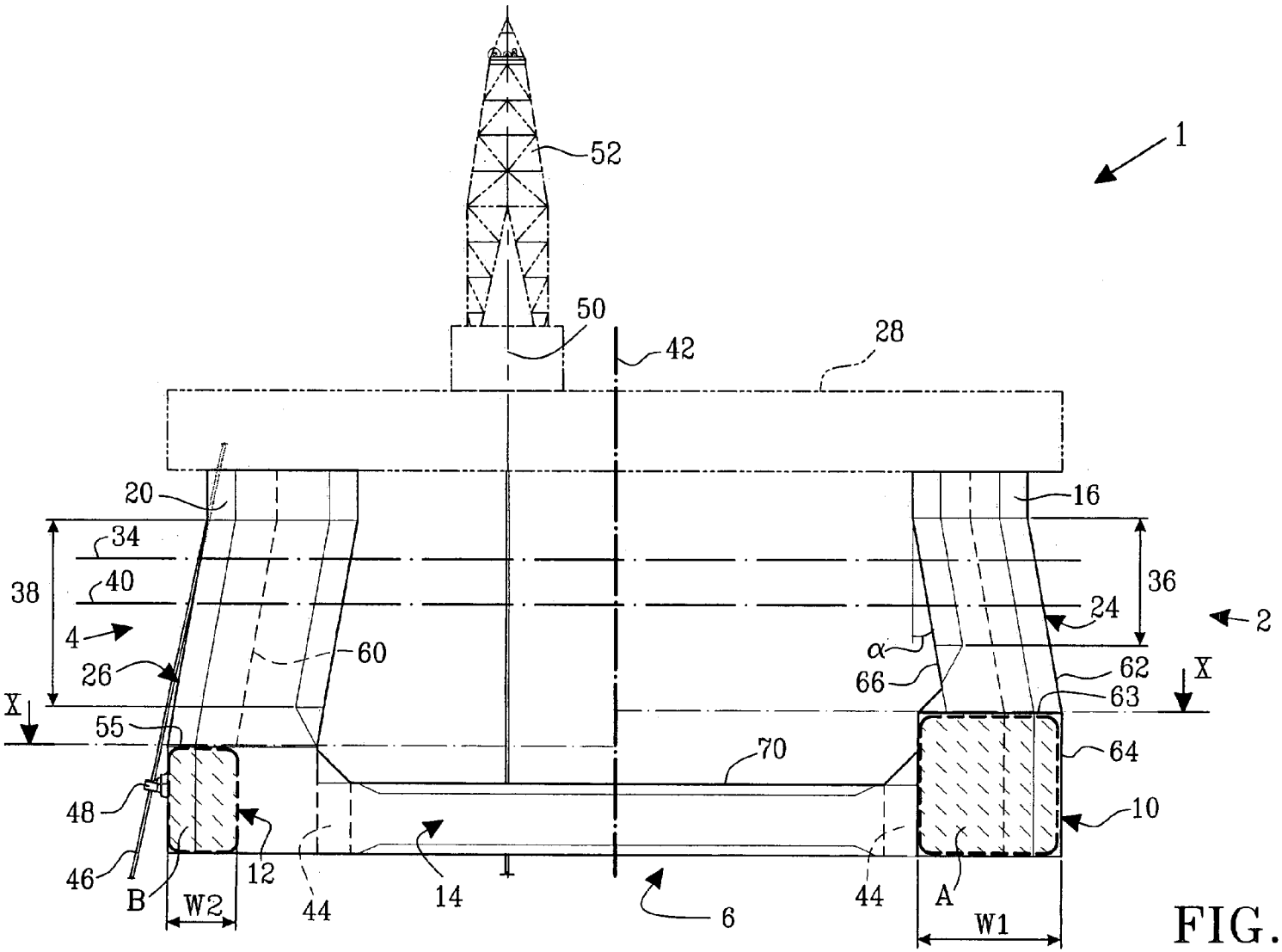
FIG. 9 shows a simplified side view of a vessel according to a second exemplary embodiment of the invention.

Preferably, the square root of the water-plane area D of the support columns 16, 18 in the first column pair 24 is less than the longitudinal mean width $W_1$ (as indicated in FIGS. 2 and 9) of the first transverse pontoon section 10.

Furthermore, the square root of the water-plane area E of the support columns 20, 22 in the second column pair 26 exceeds the longitudinal mean width $W_2$ of the second transverse pontoon section 12.

As can be seen in the perspective view of FIG. 1, the edge portions 23 of the ring-pontoon 6 each has a horizontal mean cross-section area F which equals or exceeds the corresponding water-plane area D, E of the respective support columns 16, 18, 20, 22.

As seen in the accompanying drawings, the support columns 16, 18, 20, 22 are inclined upwardly and substantially radially inwardly from the ring-pontoon 6 to the upper deck-structure 28 towards a vertical centerline 42 of the vessel 1. More particularly, as shown in the side view of FIG. 2 and the front view in FIG. 7, the support columns 16, 18, 20, 22 are inclined inwards with an inclination angle $\alpha$ both in the longitudinal direction and the transversal direction of the vessel 1. The inclination angle $\alpha$ may suitably range between 10–15°.

In both exemplary embodiments, the edge portions 23 of the support columns 16, 18, 20, 22 include narrowing transition cone elements 44 adapted to bridge differences in cross sectional areas between pontoon sections 10, 12, 14 and the edge portions 23. For example, the narrowing transition cone elements 44 are clearly visible in FIGS. 1–3, as well as in FIGS. 9 and 10.

As is further shown in the FIGS. 1 and 2, as well as in other FIGs., several catenary riser pipes 46 are attached to said second pontoon section 12 at attachment points 48 in a translation-fixed and rotationally elastic manner. The offshore vessel 1 is connected to sub-sea wellheads (not shown) and other installations via these catenary riser pipes, and drilling operations as well as seabed-to-surface transportation of hydrocarbons are effected through the catenary riser pipes 46. Since vessels 1 of the shown type often operate at considerable depths, the catenary riser pipes often has a considerable length—often several thousand meters long. The catenary riser pipes 46 are often made of steel, and are sensitive to metal fatigue as the riser pipes 46 are subjected to forces and motions caused by the wave excited heave, roll and pitch movements of the semi-submersible offshore vessel 1. However, by positioning the catenary riser pipes 46 at or near the second transversal column 12, fatigue problems are minimized due to the favourable heave characteristics of the vessel 1 according to the invention. This is due to the fact that the inventive concept involves concentrating the motion reducing measures to the second end 2 of the vessel 1, with the objective to locally minimize the vertical motions within the wave period range below 7–8 seconds. In order to do this, both the vertical translation (heave) and the rotation (pitch or roll) multiplied with the lever arm from the center of rotation has to be minimized. The inventive approach is to move the center of rotation—which in FIG. 2 is positioned along the vertical dash-dotted line 50—towards the second end 2 of the vessel 1, and to balance the wave exciting forces in heave and pitch in order to obtain as much counteracting wave forces as possible.

This is achieved by rendering the second end 4 of the vessel 1 rotationally "stiff" by providing the support columns 20, 22 in the second column pair 26 with relatively large water-plane areas E, in combination with a relatively slender conFIG.uration of the second transversal pontoon section 12, which results in low exciting forces in the vertical direction at the second end 4 compared to the first end 2 of the vessel 1. The first end 2, on the other hand, is rendered rotationally "weak" by providing the support columns 16, 18 in the first column pair 24 with relatively small water-plane areas D, in combination with a relatively wide configuration of the first transversal pontoon section 10—which results in higher exciting forces in the vertical direction at the first end 1.

If the vessel 1 is provided with a derrick 52 for performing offshore drilling operations, as shown in FIGS. 2 and 9 respectively, it is advantageously positioned near the second end 4 of the vessel 1, in order to benefit from the locally reduced heave motions at this end 4. This positioning of the derrick 52 near the second end 4 will thus facilitate drilling operations.

Figure 4:
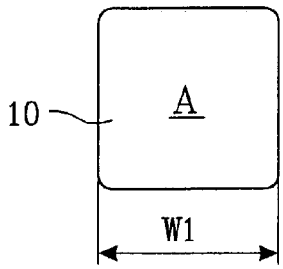
FIG. 4 shows a diagrammatic cross-section of the first pontoon section, taken along line IV—IV in FIG. 3.

With reference now primarily to the diagrammatical cross-sectional FIGS. 4–6, the mutual size relations between the pontoon sections 10, 12, 14 will be described. Thus, Advantageously, the first transversal pontoon section 10—the cross-section of which is shown in FIG. 4—has a vertical mean cross-section area A which exceeds the corresponding vertical mean cross-section area B of the second pontoon section 12 (shown in FIG. 5) by a factor of between 1.5 and 4.0, preferably between 2.0 and 3.0.

Figure 5:
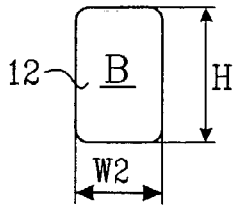
FIG. 5 shows a diagrammatic cross-section of the second pontoon section, taken along the line V—V in FIG. 3.
Figure 6:
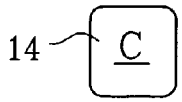
FIG. 6 shows a diagrammatic cross-section of one of the side pontoon sections, taken along line VI—VI in FIG. 3.

Furthermore, as seen in a comparison between FIGS. 5 and 6, the second transverse pontoon section 12 has a vertical mean cross-section area B which exceeds the corresponding vertical mean cross-section area C of each of the two longitudinal pontoon sections 14.

As is further apparent from FIG. 5, the second transverse pontoon section 12 has a height (H) which exceeds its width, above referred to as its longitudinal mean width $W_2$.

In an advantageous embodiment, the support columns 20, 22 in the second column pair 26 each has a water-plane area E which exceeds the water-plane area D of each of the support columns 16, 18 in the first column pair 24 by a factor of between 1.3 and 2.5, preferably between 1.5 and 2.0.

In the second exemplary embodiment of the invention, as shown in FIGS. 9–12, the second transverse pontoon section 12 and the two longitudinal pontoon sections 14 have are displaced radially outwards when compared to the first exemplary embodiment shown in FIGS. 1–8. Since all other features remain substantially the same as in the first embodiment, the reference numerals used above also apply to the second embodiment as well as the third and fourth embodiments described below. In the second embodiment, as may be clearly seen in FIG. 10, the second transverse pontoon section 12 has an outer side 54 which at least at pontoon top level—indicated by reference numeral 55 for the second transverse pontoon section 12—is aligned with transverse outer sides 56 of the support columns 20, 22 in the second column pair 26. Further, an inner side 58 which at least at pontoon top level 55 is aligned with a transverse internal bulkhead 60 within said support columns 20, 22 in the second column pair 26.

As is further shown in FIGS. 2 and 9, the support columns 16, 18 in the first column pair 24 each has a transverse outer side 62 which at least at pontoon top level—indicated by reference numeral 55 for the first transverse pontoon section 10—is aligned with an outer side 64 of the first transverse pontoon section 10. This applies both to the first and the second embodiment.

Figure 10:
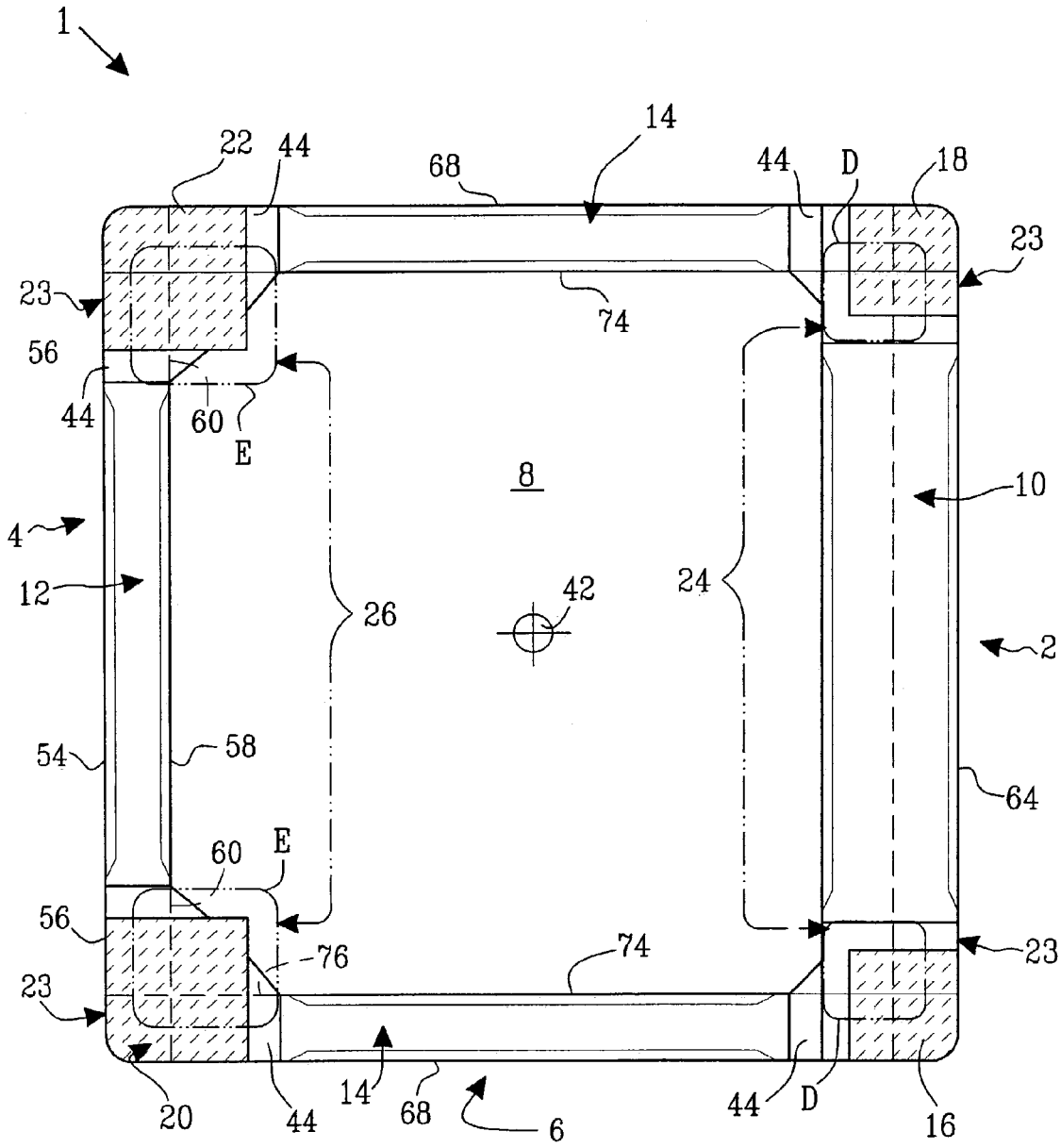
FIG. 10 shows a top cross-sectional view of the vessel according to the second exemplary embodiment, taken along line X—X in FIG. 9.

In the second embodiment of FIG. 10, the longitudinal pontoon sections 14 each have an outer side 68 which at least at pontoon top level—indicated by reference numeral 70 for the longitudinal pontoon sections 14—is aligned with a respective longitudinal outer side 72 of the support columns 16, 18, 20, 22. Further, an inner side 74 of each longitudinal pontoon section 14—at least at pontoon top level 70 is aligned with a respective longitudinal internal bulkhead 76 within each of said support columns 16, 18, 20, 22.

Figure 3:
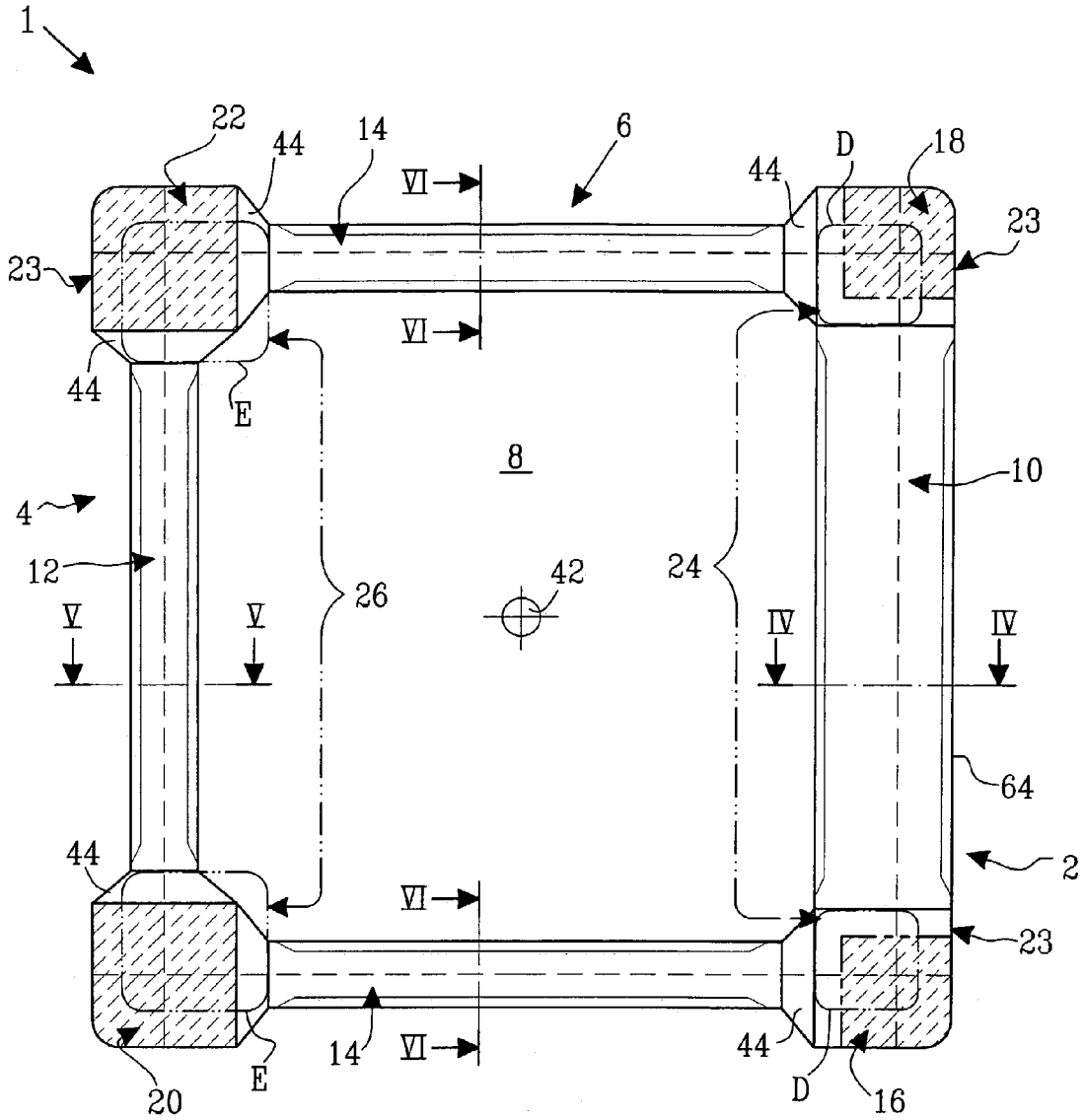
FIG. 3 shows a top cross-sectional view of the vessel according to the first exemplary embodiment, taken along line III—III in FIG. 2.

In FIGS. 3 and 10, in order to more clearly illustrate the different aligned sides and bulkheads described above, the base surfaces of respective support columns 16, 18, 20, 22 are shown at the respective pontoon top levels 55, 63 as hatch markings, whilst the water-plane areas E, D of the respective support columns are indicated with dashed lines and displaced radially inwards as a result of the inclination of the support columns 16, 18, 20, 22.

Figure 7:
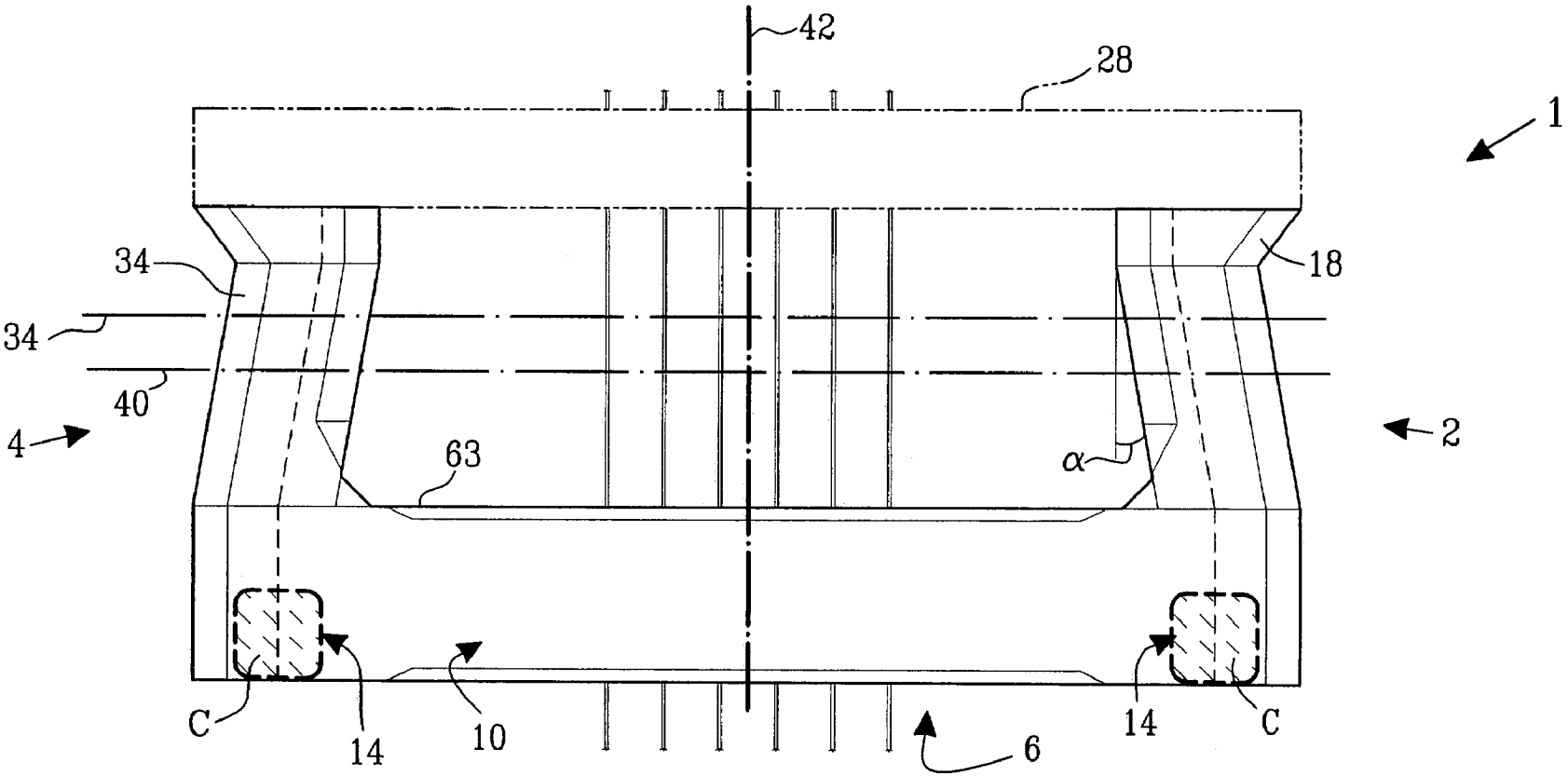
FIG. 7 shows a simplified front view of a vessel according to the first exemplary embodiment of the invention.
Figure 8:
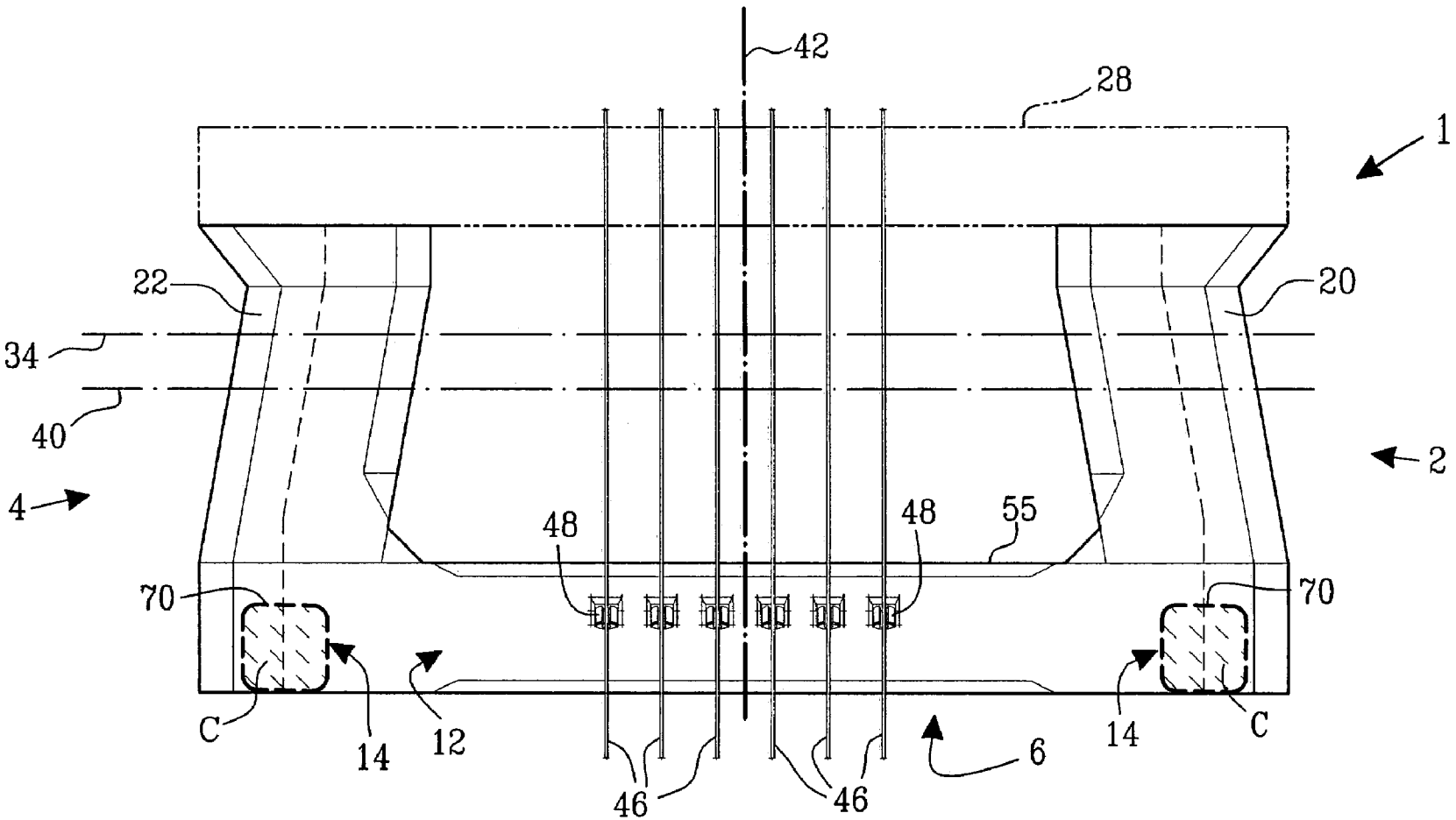
FIG. 8 shows a simplified aft view of a vessel according to the first exemplary embodiment of the invention.
Figure 11:
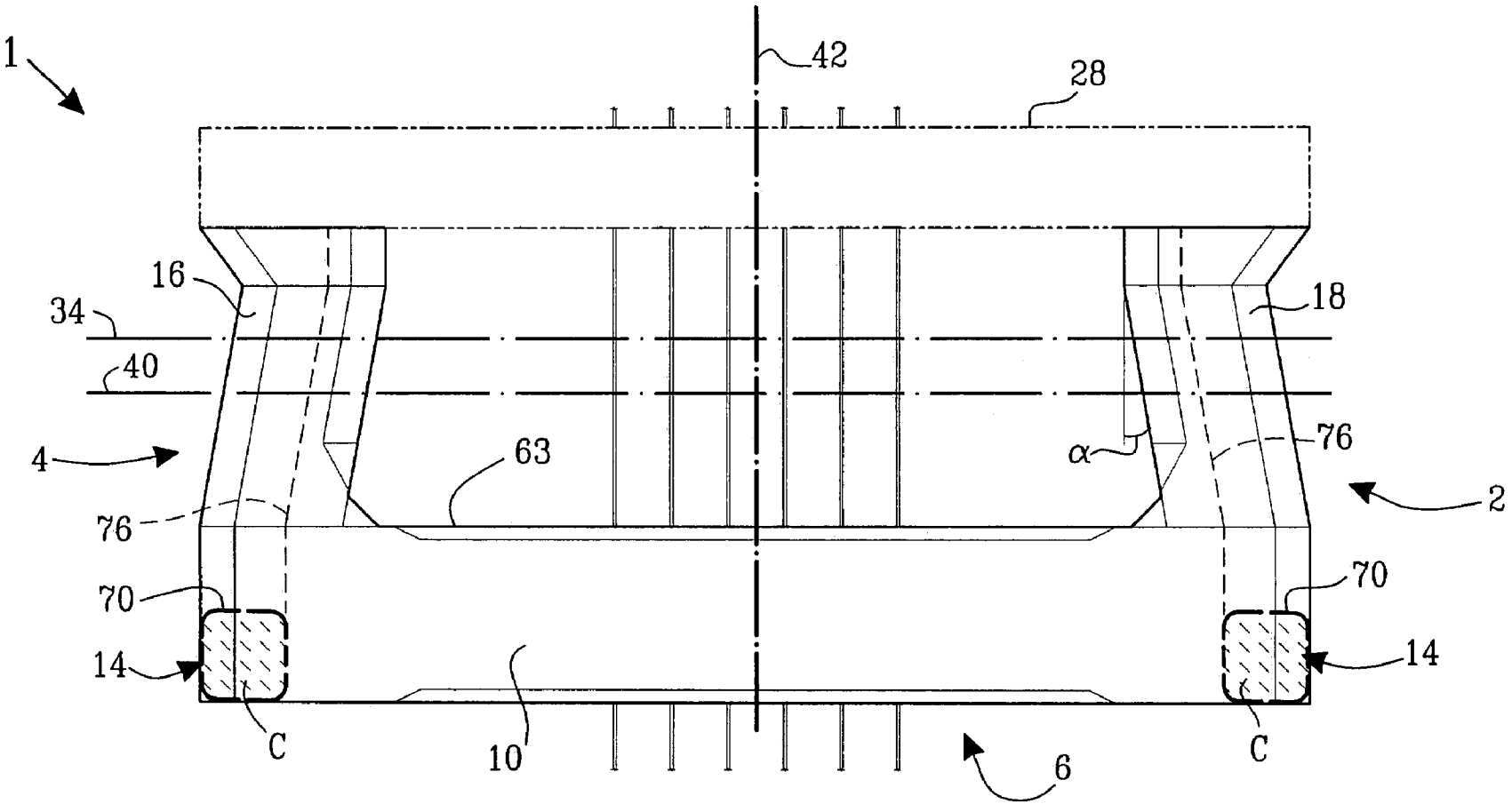
FIG. 11 shows a simplified front view of a vessel according to the second exemplary embodiment of the invention.
Figure 12:
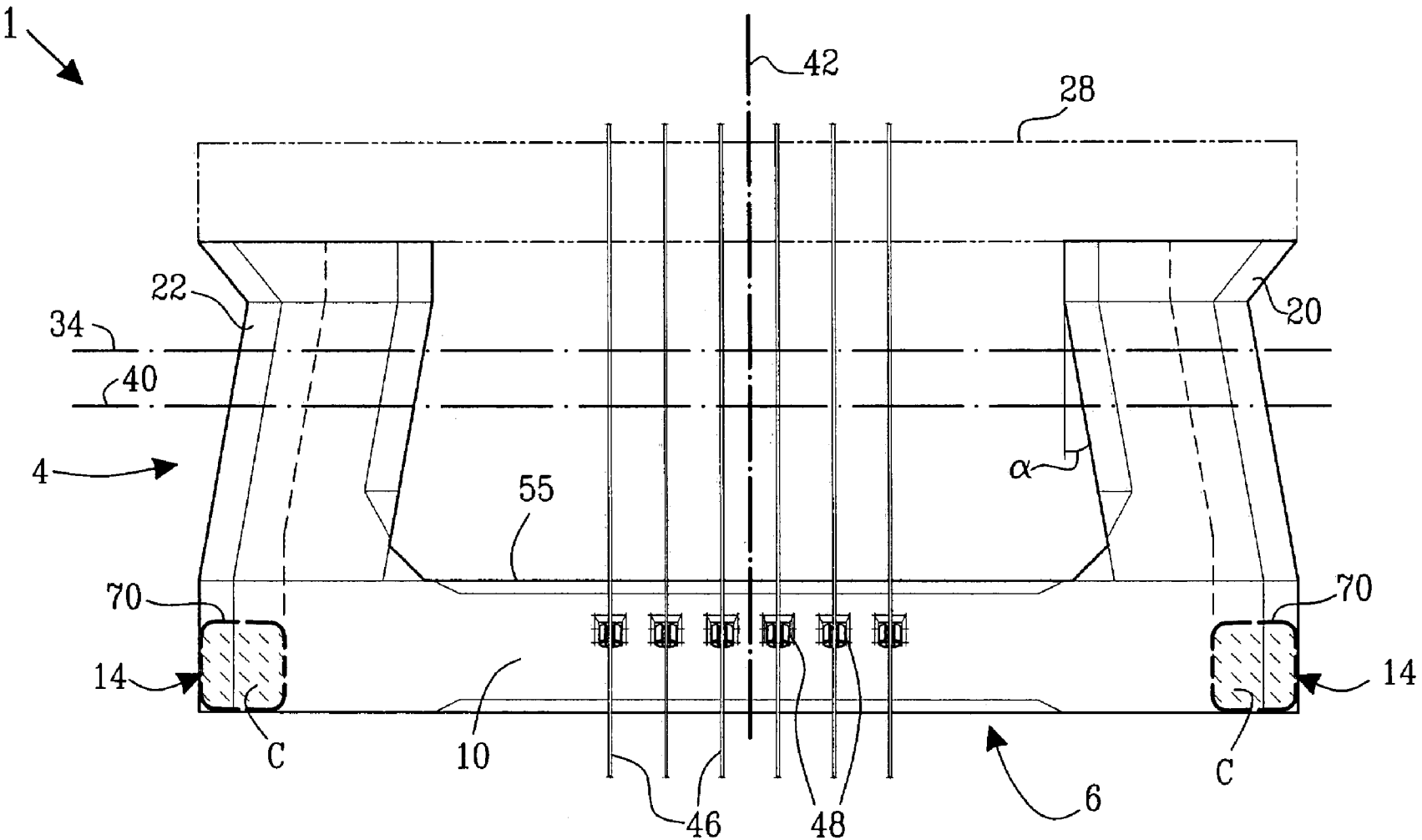
FIG. 12 shows a simplified aft view of a vessel according to the second exemplary embodiment of the invention.
Figure 13:
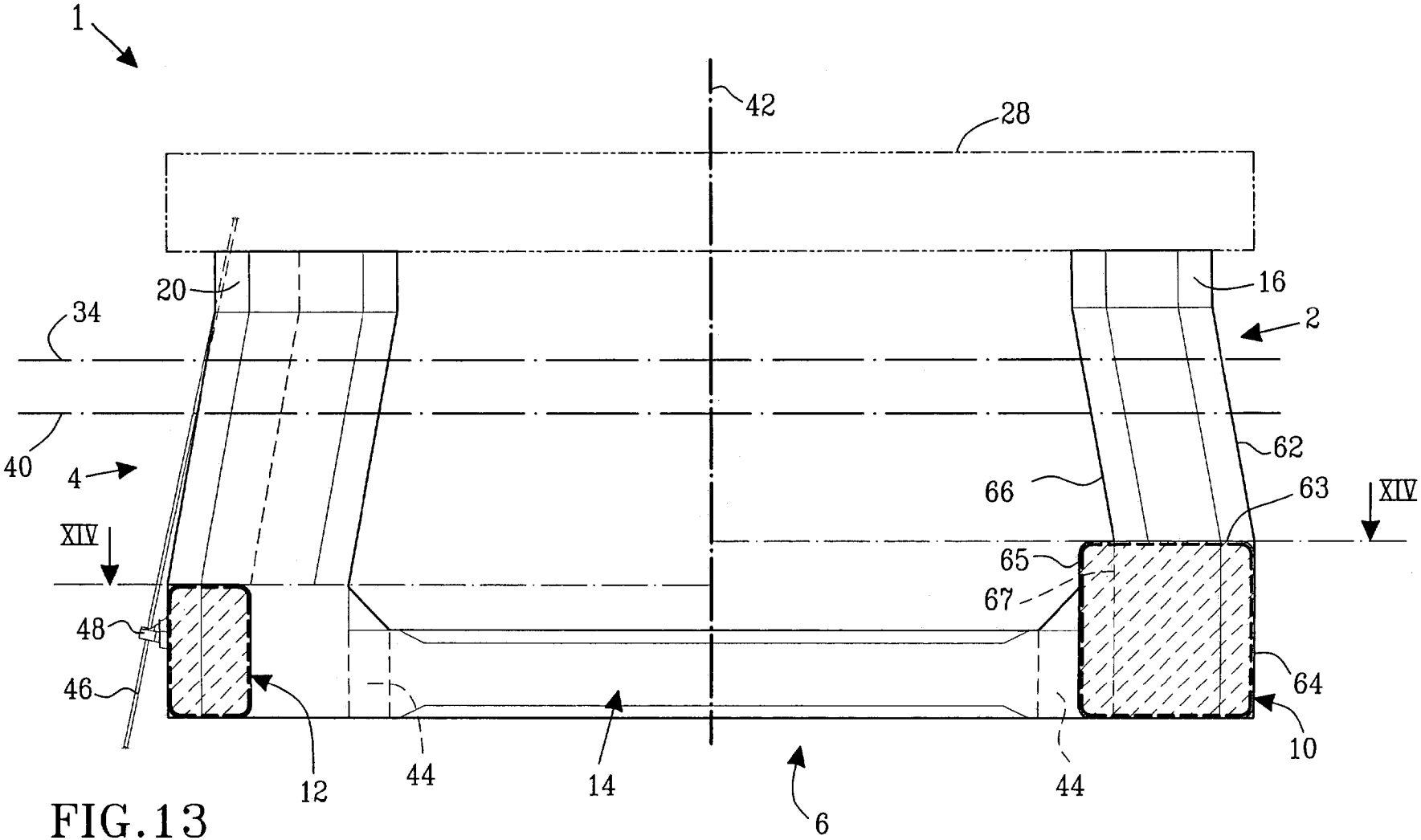
FIG. 13 shows a simplified side view of a vessel according to a third exemplary embodiment of the invention.
Figure 14:
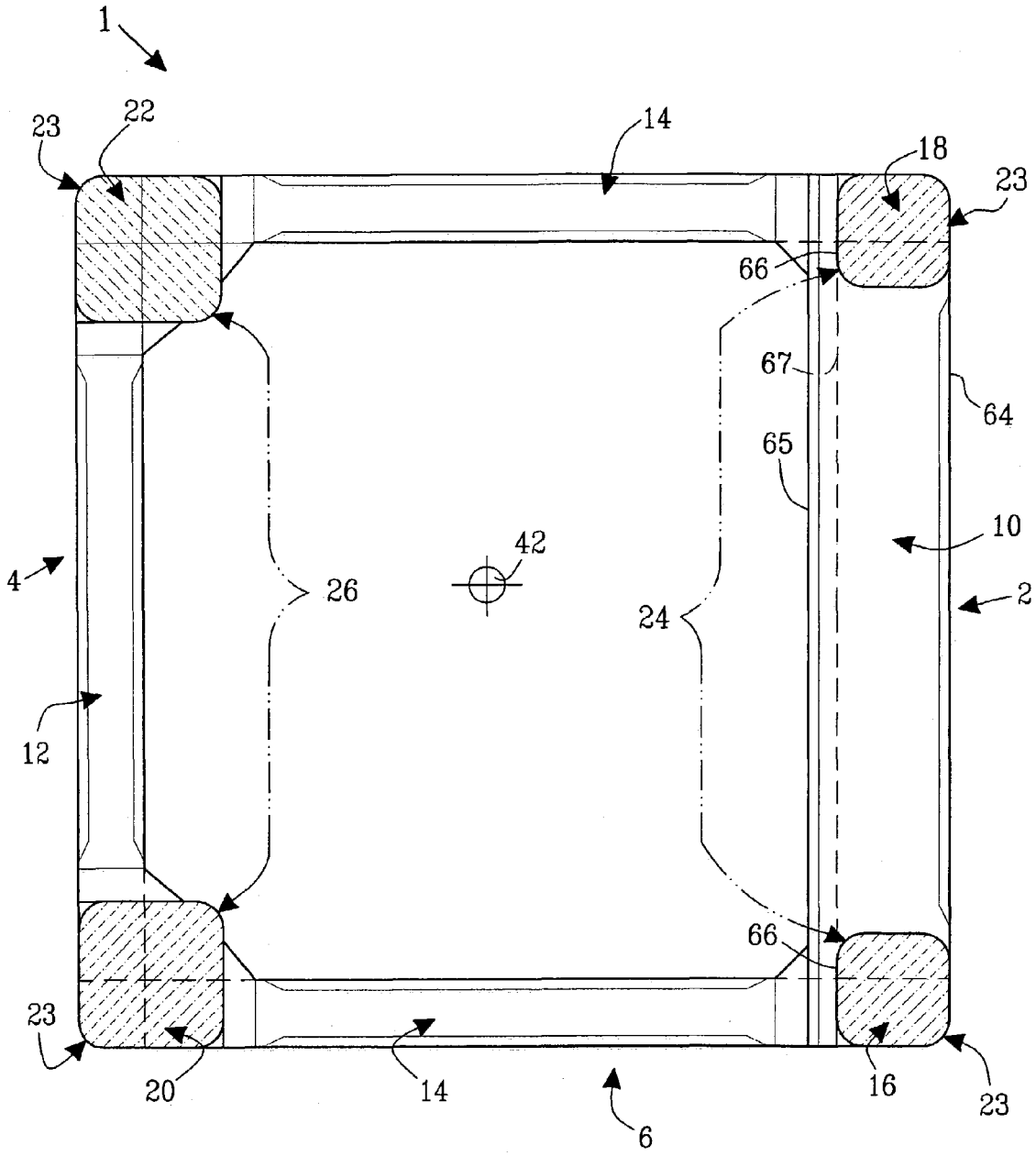
FIG. 14 shows a top cross-sectional view of the vessel according to the third exemplary embodiment, taken along line XIV—XIV in FIG. 13.

FIGS. 7 and 11 respectively, show front views of the first and second exemplary embodiments. FIGS. 8 and 12 respectively, show aft views of the first and second exemplary embodiments, in which the catenary riser pipes and their attachment points 48 are clearly visible. In FIGS. 13–14, a third exemplary embodiment of the invention is shown, wherein the support columns 16, 18 in the first column pair 24 each has: a transverse outer side 62 which at least at pontoon top level (indicated by reference numeral 63 for the first transverse pontoon section 10) is aligned with an outer side 64 of the first transverse pontoon section 10, and a transverse inner side 66 which at least at pontoon top level 63 is aligned with a transverse internal bulkhead 67 within said first transverse pontoon section 10.

Figure 15:
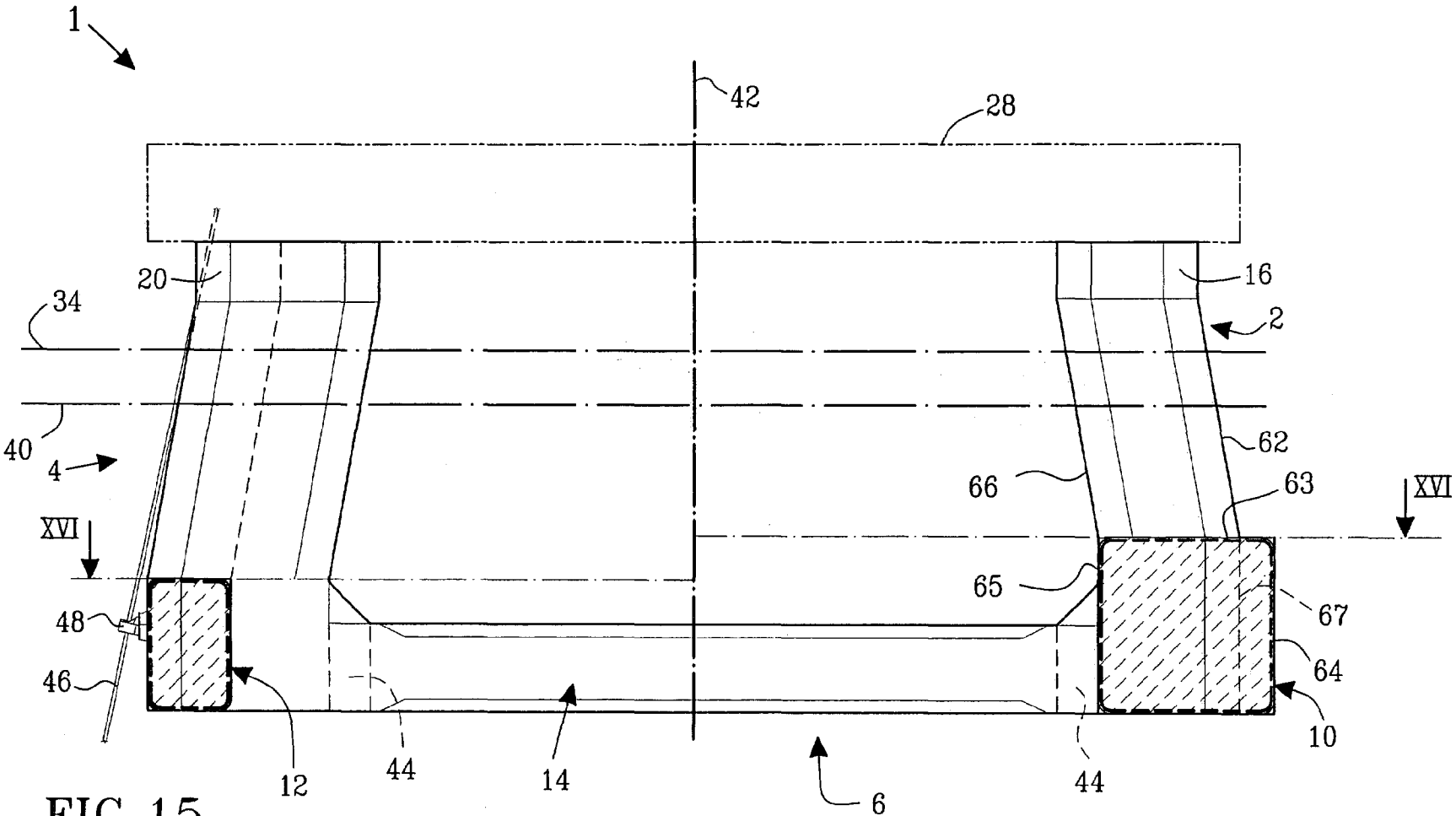
FIG. 15 shows a simplified side view of a vessel according to a third exemplary embodiment of the invention, and FIG. 16 finally shows a top cross-sectional view of the vessel according to the third exemplary embodiment, taken along line XVI—XVI in FIG. 15.
Figure 16:
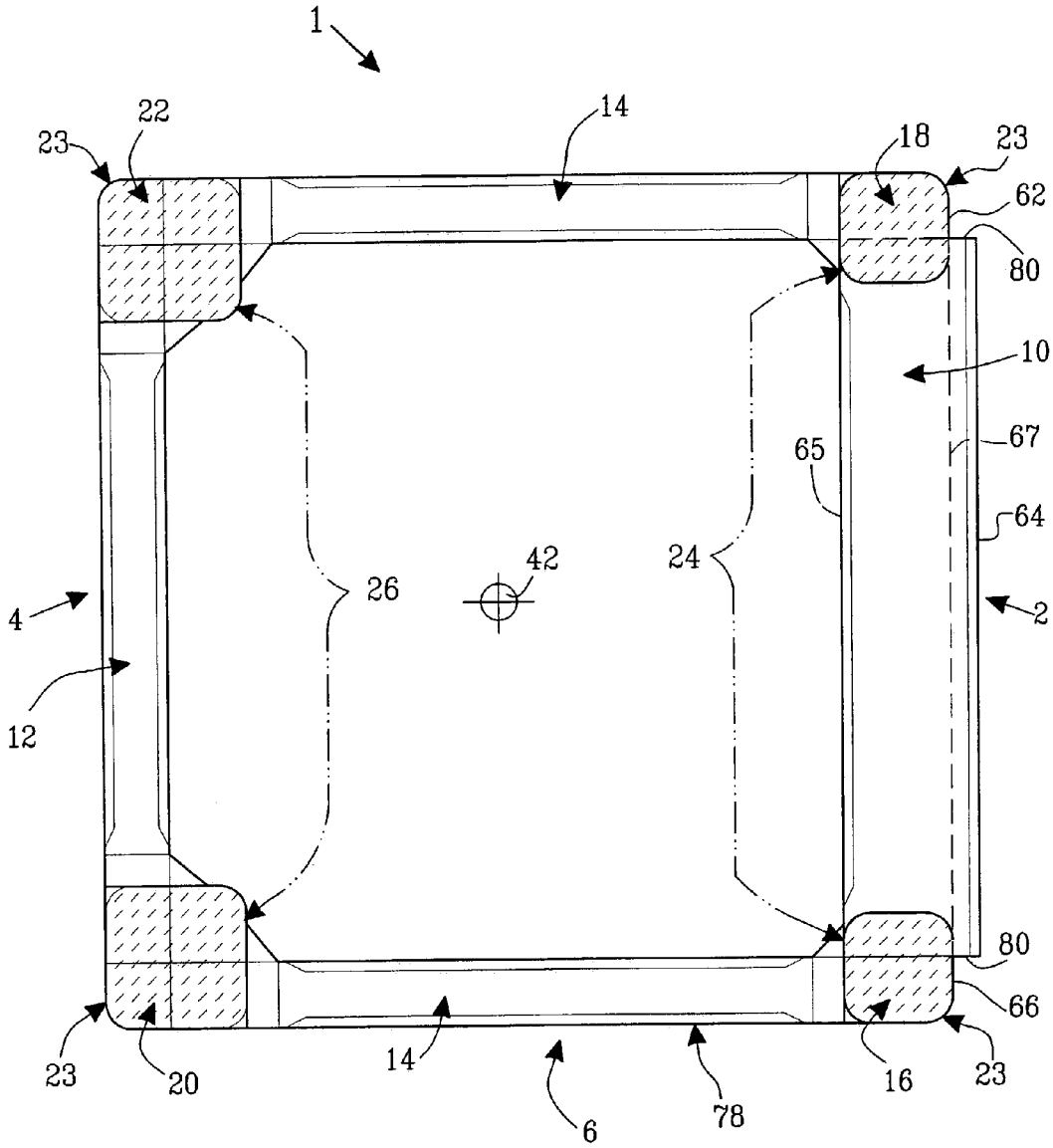

In FIGS. 15–16, a fourth exemplary embodiment of the invention is shown, wherein the support columns 16, 18 in the first column pair 24 each has a transverse outer side 62 which at least at pontoon top level 63 is aligned with a transverse internal bulkhead 67 within said first transverse pontoon section 10, and a transverse inner side 66 which at least at pontoon top level 63 is aligned with an inner side 65 of the first transverse pontoon section 10.

In this embodiment, the outer side 64 of the first transverse pontoon section 10 extends outside of the otherwise continuous external periphery 78 of the ring-pontoon 6 in such a way that a square step 80 is formed at each end of the first transverse pontoon section 10 in the transition to the edge-portions 23. However, other alternative shapes of this transition may of course also be used within the scope of the invention. Thus, instead of a square step 80, the transition may be rounded or angled.

It is to be understood that the invention is by no means limited to the embodiments described above, and may be varied freely within the scope of the appended claims. For example, the support columns 16, 18, 20, 22 need not necessarily be inclined as in the shown embodiments, but may instead be conventionally extend vertically from the ring-pontoon 6 to the upper deck structure 28.

The invention being thus described, it will be obvious that the same may d in many ways. Such variations are not to be regarded as a departure from t and scope of the invention, and all such modifications as would be obvious killed in the art are intended to be included within the scope of the following List of Reference Numerals:

1. Semi-submersible Offshore vessel
2. First end
4. Second end
6. Ring-pontoon
8. Central opening in ring-pontoon
10. First transverse pontoon section
12. Second transverse pontoon section
14. Longitudinal pontoon sections
16. Support column, first end
18. Support column, first end
20. Support column, second end
22. Support column, second end -continued

| | |
|---|---|
| 23. | Edge portions of ring-pontoon |
| 24. | First column pair |
| 26. | Second column pair |
| 28. | Upper deck structure |
| 30. | Beams of upper deck structure |
| 32. | Operation modules |
| 34. | Operational draught waterline |
| 36. | Vertical portion of first column pair, with constant water-plane area |
| 38. | Vertical portion of second column pair, with constant water-plane area |
| 40. | Storm draught waterline |
| 42. | Vertical centerline |
| 44. | Transition cone elements |
| 46. | Catenary riser pipes |
| 48. | Attachment points for catenary riser pipes |
| 50. | Vertical line, along which the center of rotation is positioned |
| 52. | Derrick |
| 54. | Outer side of second transverse pontoon section |
| 55. | Pontoon top level for second transverse pontoon section |
| 56. | Transverse outer sides of support columns in second column pair |
| 58. | Inner side of second transverse pontoon section |
| 60. | Transverse internal bulkhead in support columns in second column pair |
| 62. | Transverse outer sides of support columns in first column pair |
| 63. | Pontoon top level for first transverse pontoon section |
| 64. | Outer side of first transverse pontoon section |
| 65. | Inner side of first transverse pontoon section |
| 66. | Transverse inner sides of support columns in first column pair |
| 67. | Transverse internal bulkhead in first transverse pontoon section |
| 68. | Outer side of longitudinal pontoon sections |
| 70. | Pontoon top level for longitudinal pontoon section |
| 72. | Longitudinal outer sides of support columns |
| 74. | Inner side of longitudinal pontoon sections |
| 76. | Longitudinal internal bulkhead in support columns |
| 78. | External periphery of ring-pontoon |
| 80. | step in external periphery |
| A. | Vertical mean cross-section area of first transverse pontoon section |
| B. | Vertical mean cross-section area of second transverse pontoon section |
| C. | Vertical mean cross-section area of longitudinal pontoon sections |
| D. | Water-plane area of each of the support columns in the first column pair |
| E. | Water-plane area of each of the support columns in the second column pair |
| F. | Horizontal mean cross-sectional area of each edge-portion |
| $W_1$ | Longitudinal mean width of first transverse pontoon section |
| $W_2$ | Longitudinal mean width of second transverse pontoon section |
| H | Height of second transverse pontoon section |
| $\alpha$ | Inclination angle of support columns |

What is claimed is:

1. A semi-submersible offshore vessel (1) exhibiting a first end (2) and a second end (4), said vessel (1) comprising:

a substantially rectangular ring-pontoon (6) including a first transverse pontoon section (10) located at the first end (2) of the vessel (1); a second transverse pontoon section (12) located at the second end (4) of the vessel (1), said second transverse pontoon section (12) being parallel to the first transverse pontoon section (10), the ring-pontoon (6) further including two mutually parallel longitudinal pontoon sections (14) extending between said first (2) and second ends (4) of the vessel (1);

at least four support columns (16, 18, 20, 22) extending upwardly from respective edge-portions (23) of said ring-pontoon (2), said support columns (16, 18, 20, 22) being arranged in a first column pair (24) located at the first end (2) of the vessel (1) and a second column pair (26) located at the second end (4) of the vessel (1); and an upper deck structure (28) positioned upon said support columns (16, 18, 20, 22), wherein the first transverse pontoon section (10) has a vertical mean cross-section area (A) which exceeds the corresponding vertical mean cross-section area (B) of the second transverse pontoon section (12), and the support columns (20, 22) in the second column pair (26) each has a water-plane area (E) which exceeds the water-plane area (D) of each of the support columns (16, 18) in the first column pair (24).

2. A semi-submersible offshore vessel (1) according to claim 1, wherein the square root of the water-plane area (D) of each of the support columns (16, 18) in the first column pair (24) is less than the longitudinal mean width ($W_1$) of the first transverse pontoon section (10).

3. A semi-submersible offshore vessel (1) according to claim 1, wherein the square root of the water-plane area (E) of each of the support columns (20, 22) in the second column pair (26) exceeds the longitudinal mean width ($W_2$) of the second transverse pontoon section (12).

4. A semi-submersible offshore vessel (1) according to claim 1, wherein the second transverse pontoon section (12) has:

an outer side (54) which at least at pontoon top level for the second transverse pontoon section (55) is aligned with transverse outer sides (56) of the support columns (20, 22) in the second column pair (26), and an inner side (58) which at least at pontoon top level (55) is aligned with a transversal internal bulkhead (60) within said support columns (16, 18) in the second column pair (26).

5. A semi-submersible offshore vessel (1) according to claim 1, wherein the support columns (16, 18) in the first column pair (24) each have:

a transverse outer side (62) which at least at pontoon top level for the first transverse pontoon section (63) is aligned with an outer side (64) of the first transverse pontoon section (10), and a transverse inner side (66) which at least at pontoon top level for the first transverse pontoon section (63) is aligned with a transverse internal bulkhead (67) within said first transverse pontoon section (10).

6. A semi-submersible offshore vessel (1) according to claim 1, wherein the support columns (16, 18) in the first column pair (24) each have:

a transverse outer side (62) which at least at pontoon top level for the first transverse pontoon section (63) is aligned with a transverse internal bulkhead (67) within said first transverse pontoon section (10), and a transverse inner side (66) which at least at pontoon top level for the first transverse pontoon section (63) is aligned with an inner side (65) of the first transverse pontoon section (10).

7. A semi-submersible offshore vessel (1) according to claim 1, wherein the first transverse pontoon section (10) has a vertical mean cross-section area (A) which exceeds the corresponding vertical mean cross-section area (B) of the second transverse pontoon section (12) by a factor of between 1.5 and 4.0.

8. A semi-submersible offshore vessel (1) according to claim 7, wherein said factor is between 2.0 and 3.0.

9. A semi-submersible offshore vessel (1) according to claim 1, wherein the second transverse pontoon section (12) has a vertical mean cross-section area (B) which exceeds the corresponding vertical mean cross-section area (C) of each of the two longitudinal pontoon sections (14).

10. A semi-submersible offshore vessel (1) according to claim 1, wherein the support columns (20, 22) in the second column pair (26) each has a water-plane area (E) which exceeds the water-plane area (D) of each of the support columns (16, 18) in said first column pair (24) by a factor of between 1.3 and 2.5.

11. A semi-submersible offshore vessel (1) according to claim 10, wherein said factor is between 1.5 and 2.0.

12. A semi-submersible offshore vessel (1) according to claim 1, wherein the support columns (16, 18, 20, 22) are inclined upwardly and substantially radially inwardly from the ring-pontoon (6) to the upper deck-structure (28) towards a vertical centerline (42) of the vessel (1).

13. A semi-submersible offshore vessel (1) according to claim 1, wherein said edge portions (23) of the ring-pontoon (6) each has a horizontal mean cross-section area (F) which equals or exceeds the corresponding water-plane area (D, E) of the respective support columns (16, 18, 20, 22).

14. A semi-submersible offshore vessel (1) according to claim 13, wherein said edge portions (23) include narrowing transition cone elements (44) adapted to bridge differences in cross sectional areas between pontoon sections (10, 12, 14) and said edge portions (23).

15. A semi-submersible offshore vessel (1) according to claim 1, wherein said second transverse pontoon section (12) has a height which exceeds its width ($W_2$).

16. A semi-submersible offshore vessel (1) according to claim 1, wherein one or more steel catenary riser pipes (46) are attached to said second pontoon section (12).

17. A semi-submersible offshore vessel (1) according to claim 1, further comprising a derrick (52) for performing offshore drilling operations positioned at said second end (4) of the vessel (1).

18. A semi-submersible offshore vessel (1) according to claim 1, wherein said first end (2) is a forward end of the vessel and said second end (4) is an aft end of the vessel.

* * * * *